United States Patent [19]

Bauer et al.

[11] Patent Number: 4,468,783

[45] Date of Patent: Aug. 28, 1984

[54] ELECTRODE FOR ARC FURNACES

[75] Inventors: Hanns G. Bauer, Witten-Bommern, Fed. Rep. of Germany; Dieter H. Zöllner, Clare, Ireland; Josef Otto; Josef Mühlenbeck, both of Wetter, Fed. Rep. of Germany; Friedrich Rittmann, Rückersdorf, Fed. Rep. of Germany; Claudio Conradty, Röthenbach a.d. Pegnitz, Fed. Rep. of Germany; Inge Lauterbach-Dammler, Nuremberg, Fed. Rep. of Germany; Horst Sonke, Leinburg, Fed. Rep. of Germany

[73] Assignee: Arc Technologies Systems Ltd., Cayman Islands

[21] Appl. No.: 285,514

[22] Filed: Jul. 21, 1981

[30] Foreign Application Priority Data

Oct. 27, 1980 [EP] European Pat. Off. ..... 106581.4

[51] Int. Cl.[3] ..... H05B 7/101

[52] U.S. Cl. ..... 373/93

[58] Field of Search ..... 373/93, 92, 91, 94

[56] References Cited

U.S. PATENT DOCUMENTS

| | | | |
|---|---|---|---|
| 4,145,564 | 3/1979 | Andrew et al. | 373/93 |
| 4,256,918 | 3/1981 | Schwabe et al. | 373/93 |
| 4,291,190 | 9/1981 | Elsner et al. | 373/93 |

FOREIGN PATENT DOCUMENTS

| | | | |
|---|---|---|---|
| 2037549 | 7/1980 | United Kingdom | 373/93 |

*Primary Examiner*—Roy N. Envall, Jr.
*Attorney, Agent, or Firm*—Woodrow W. Ban

[57] ABSTRACT

Electrodes for arc furnaces comprising a top portion (5) of metal and a replaceable bottom portion (6) of material which is only slowly consumable, being substantially cylindrical shape and the portions being interconnected by means of a screw nipple (1) or the like and the top portion has a liquid cooling device with a header duct (2) and a return duct (3) and the top portion (5) is advantageously protected in the bottom region thereof by means of an insulating coating of high temperature stability representing a detachably surmountable moulding. An electrically conductive intermediate layer of high temperature stability can be provided between the insulating moulding and the top portion. The electrodes are only slightly trouble prone, have emergency operating properties, have a high mechanical stressability and are easy to repair.

19 Claims, 4 Drawing Figures

ELECTRODE FOR ARC FURNACES

FIELD OF THE INVENTION

This invention relates to arc furnace electrodes having a metallic top portion and a replaceable consumable bottom portion of generally substantially cylindrical shape, each portion being joined to the other by a threadable interconnection, for example a screw nipple or the like, in which the top portion is provided with a liquid cooling device having header and return ducts, at least part of the top portion being protected by an insulating coating of high temperature stability.

BACKGROUND OF THE INVENTION

Electrodes of this kind have been described in the Belgian Patent Specification No. 867,876. The metal shank of such electrodes contains the cooling system and is covered by an externally disposed compound of high temperature stability, generally being a continuous coating, hooks in the metal shank being provided to improve adhesion.

Similar electrodes are also shown by the British Patent Specification No. 1,223,162 wherein the entire metal shank is covered with a protective ceramic coating. According to this solution of the problem, efforts are made to ensure that the ceramic coating is as thin as possible and penetrates into the metal shank itself to provide a substantial degree of insulation of the cooling tubes extending therein. These tubes simultaneously function as cooling water duct and provide the electrical connection to the consumable graphite electrode part.

The European Patent Application 79 302 809.3 describes an electrode in which the mechanical contact of the metal shank, disposed laterally and externally of the shank, is supported so as to be insulated with respect to the internally disposed metallic cooling system. The bottom part of the metallic cooling shank is again provided with a ceramic coating, secured by hooks and extending approximately to the height of the screw nipple connection.

Electrodes for arc furnaces are exposed to severe stresses. This is in part explained by the elevated operating temperatures, for example in the production of electrode steel, for which such electrodes are most frequently employed. Losses due to side oxidation are also caused at the electrode tip only in an ideal case. Finally, there is the risk of travelling or lateral striking of the arc which can also take place above the consumable part in the event of defects and can lead to short circuits. Furthermore, the electrodes are subject to different temperatures associated with feed and return of the coolant and in the threadable interconnection region of the consumable part by comparison with the cooled power supply unit. The region of the screw nipple represents a particularly endangered region.

Additional and substantial mechanical stresses result from the insertion of the electrodes, boiling distortion and also result from scrap pieces sliding into the melt.

Due to the stringent requirements made on electrodes, constant improvement is required. It is, therefore, the object of the invention to provide electrodes of high activity having a reduced current drop and reduced voltage drop in the electrical supply leads, with a reduced tendency to be trouble prone but being also easy to manufacture and to repair. Particularly in cases of undesirable shift of the arc or excessive mechanical stresses, such electrodes must allow the arc furnace process to be continued, even in the event of partial damage, in a manner which is improved compared with that of conventional electrodes.

DISCLOSURE OF THE INVENTION

This is solved by an electrode of the kind generally as described hereinbefore wherein the insulating coating is a moulding and detachably slideably mounted.

The insulating moulding of high temperature stability can be represented by an individual tube. However, it can also advantageously be a series of tubular sections, segments, half shells or the like which surround a bottom region of the top portion of the electrode extending to the region of the screw nipple, and where appropriate, beyond said screw nipple. The material of the insulating moulding can be a high temperature resistant ceramic but also graphite which is covered with a coating. Such insulating, ceramic or other materials of high temperature stability are known. A plurality of advantages are achieved by the use of a loosely or slideably surmounted moulding, more particularly in the form of a series of tubular sections, segments or half shells.

According to one preferred embodiment of the electrode according to the invention, the insulating moulding is disposed between a bottom region of the metallic top portion and the bottom consumable portion so that the external moulding edges extending in the direction of the electrode axis and the external edges of an upper region associated with the top portion of the metal are substantially flush each with the other.

The electrode, according to the invention, is not subject to any restrictions regarding any abutment which supports the moulding. This abutment can also be a mating member of insulating material of high temperature stability, the screw nipple itself and, where appropriate, can also be a portion of the consumable part itself, or a combination thereof. Generally, however, the insulating moulding will not bear solely on the consumable part but will be at least partially supported by a non-consumable, heat resistant insulating material.

The position of the moulding can, of course, be suitably controlled during production of the electrode. In a preferred embodiment of the electrode, according to the the invention, the insulating moulding can be thrust upon an abutment, for example, by the additional provision of springs, through-pins, screw fasteners and the like provided in bores in the top portion, even during operation of the electrode and without the need for removing the electrode from the furnace. Irrespective of the provision of bores, screw fasteners or the like, it is advantageous to mount the insulating moulding slidingly or loosely with respect to the metal shank, so that in the event of failure of a part segment or breakage of an individual tube, for example, due to mechanical damage, the remaining intact part segments or the individual tube itself follows movably in the direction of the longitudinal electrode axis.

In one preferred embodiment, the electrode, according to the invention, is arranged so that an electrically conductive intermediate layer of high temperature stability is introduced between the insulating moulding of high temperature stability and the internally disposed part of the metal shank. By analogy to the externally disposed insulating moulding, the electrically conductive intermediate layer can also be an individual tube or a series of tubular sections, segments, half shells or the like. Electrically conductive felt of high temperature stability or fabric can also be used as such an intermediate layer in place of preformed mouldings. The electrically conductive intermediate layer can comprise a combination of a series of tubular portions together with a felt or fabric of high temperature stability for some uses of the electrode according to the invention. The use of conductive felt or fibres, generally non-woven material of high temperature stability is preferred, more particularly for uses in which the electrode is exposed to mechanical shock or vibration during operation. The introduction of the felts and the like permits the externally insulating parts to be resiliently supported contributing to the additional stabilization of the electrode.

The electrically conductive intermediate layer can consist of conductive ceramic, graphite, ceramic, mineral or carbon fibres, fabric or felts or a combination thereof.

Where an extreme safety design of the electrode is essential, it is additionally possible to provide the internally disposed metal shank, protected by the electrically insulating and the electrically conductive coating, with an additional highly stressable conductive and thin coating. This can be a ceramic coating.

Depending on the use of the electrode, it is possible to surmount the insulating moulding as well as the conductive intermediate layer on retainers which can advantageously be attached to the metal of the internal cooling unit. This will be considered primarily for uses of the electrodes where the free movability or "follow up" of intact (insulating or electrically conductive) individual segments is not essential if a segment disposed below is damaged.

Within the scope of the invention, it is also possible that the insulating moulding may not surround the entire region of the metal shank which is to be protected, and an insulating, highly refractory injection compound, anchored to retaining members, is used in place of the mouldings in a zone where lower stresses can be expected. Such insulating injection compounds are known and can be attached by any suitable or conventional retaining means, for example by soldering.

The electrodes, according to the invention, achieve a number of advantages. Firstly, the insulating moulding as well as the electrically conductive coating is simple to provide during manufacture. The mechanical stressability can be improved by the use of an insulating, externally disposed solid member. This is particularly important for electrodes which are used for the production of electrosteel. Immersion of scrap into the melt can lead to substantial agitation of the melt with a corresponding mechanical loading. By subdividing the insulating as well as the conductive external zones into segments or mouldings, it is, therefore, not necessary, in the event of defects or damage, to replace the entire electrode, since the damage can be economically and rapidly remedied by the introduction of an appropriate moulding or segment part. By virtue of the loose mounting of both the insulating moulding and also of the conductive coating to the extent to which this intermediate layer comprises mouldings, any mechanical or other destruction of protective segments situated below causes "automatic" follow up of the segments slideably disposed upon the metal shaft above and this can be additionally ensured, where appropriate, by attached springs. The electrode, therefore, continues to be operational even after having incurred damage, since the most endangered electrode region at the bottom, nearest to the working zone of the electrode, is "automatically" protected by the sliding down of intact elements. Mechanical shock due to sliding scrap, distortion and the like is absorbed by the resilient support of the insulating layer in the axial part of the electrode as well as by the internal cushioning of the electrically conductive coating comprising fibres, carbon felt and fabric and the like, in a particularly advantageous manner.

The insulating moulding as well as the insulating intermediate layer, if this comprises a series of individual segments, half shells or the like provides some clearance dictated by the kind of axial and internal support, but because of the tongue and groove system of such segments, the sensitive metal region of the electrode is completely and comprehensively protected. If the "protective shield" of the electrode is nevertheless damaged, it can usually continue to operate until the consumable part is replaced, as is in any case necessary. When the electrode is removed, the damaged individual segments, etc. can readily be replaced without any additional effort.

The internally disposed, electrically conductive coating of material having high temperature stability, such as conductive ceramic or graphite or carbon felts and the like can also confer emergency operating properties on the electrode. If the outer ring breaks, the internally disposed electrically conductive coating will be able to withstand the temperatures of an arc which might be formed. The relative sensitive, internally disposed metal shank is thus protected against the heat of an arc, which may strike from the side, so that the electrode does not immediately fail. The last-mentioned defect can arise in conventional electrodes when the externally disposed, insulating coating is mechanically or otherwise destroyed and the arc strikes directly on the shank of the electrode metal portion which is unable to withstand the extreme arc temperatures which then occur.

Some specially preferred electrode constructions of the invention are shown in FIGS. 1 to 4. The drawings particularly show electrodes in which the top portion of the conductive metal has a top part of large diameter and a bottom part of smaller diameter. The part of smaller diameter is then at least partially covered by the insulating moulding and by the conductive coating. This arrangement is particularly preferred with the scope of the invention although the invention is not confined thereto nor to the particularly advantageous embodiments in accordance with the illustrations below. Identical components have identical reference numerals in the accompanying drawings in which:

BEST EMBODIMENT OF THE INVENTION

Figure 1:
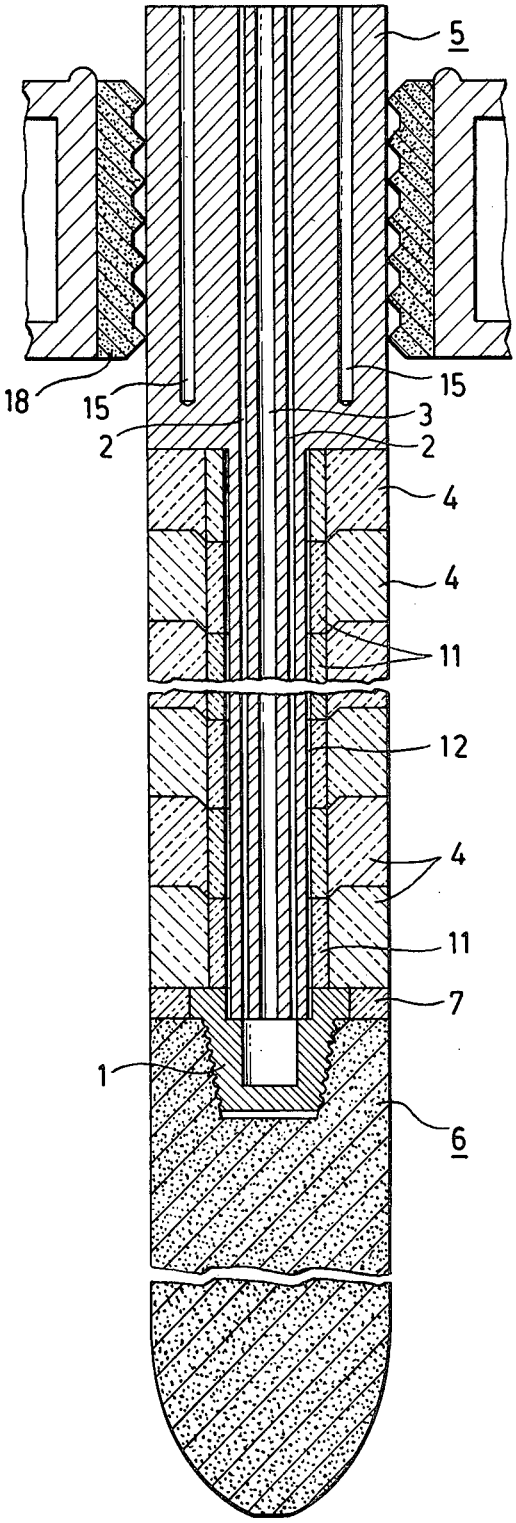
FIG. 1 is a longitudinal section through an electrode according to the invention.

In the electrode, according to FIG. 1, received in clamping jaws 18, the cooling medium, usually water, is introduced through the header duct 2 and returned through the return duct 3. The cooling medium also enters into a chamber within a generally cast iron screw nipple 1. The metallic top portion 5 comprises an upper region of larger diameter and a lower region of smaller diameter and extends to the screw nipple 1 to effect a connection to the lower portion 6 of consumable, generally graphic material. Joinder between the lower region 12 of the metal shank 5 and the nipple 1 can be effected by any suitable or conventional well known means such as screw threading, and the like. So-called reverse nippling may be employed as is well known to those skilled in the art of arc furnaces electrodes.

The insulating moulding 4 can be supported by an abutment 7, for example, of an insulating ceramic having high temperature stability. In the top region, the insulating moulding 4 extends to the bottom surface of the upper region of generally larger diameter of the metal shank. The insulating moulding 4 adjoins the electrically conductive intermediate layer 11 which surrounds a lower region 12 of the metal shank 5. In the electrode illustrated in FIG. 1, the insulating moulding 4, as well as the electrically conductive intermediate layer 11, are subdivided into segments which can slide in the direction of the electrode axis in the event of breakage of a (lower) segment. Each segment, 4 and 11, includes an inside diameter sufficiently greater than an outside diameter of the metallic portion 5 to permit, at furnace operating temperature, slideable movement of the mouldings longitudinally along the metal portion 5.

Bores 8, with inserted pins 9, which ensure proper seating of the insulating moulding when biased by a spring 10, can be provided adjacent to the cooling ports 15.

Figure 2:
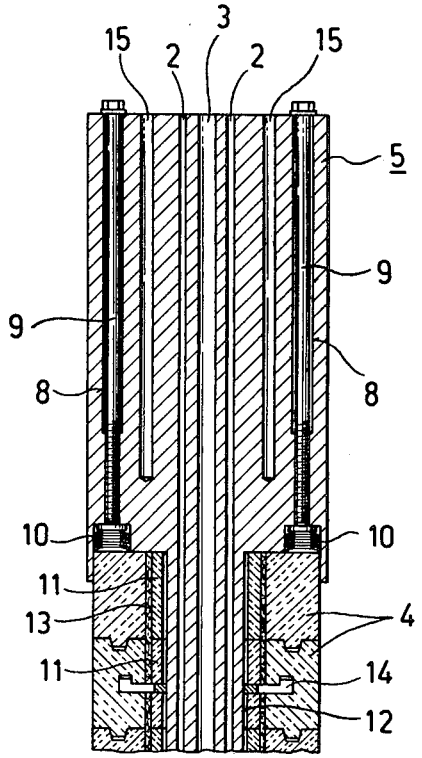
FIG. 2 is a side elevational view partially in cross-section through an electrode according to the invention in which the region protected by the insulation is not completely shown and the adjoining consumable part is not shown.
Figure 4:
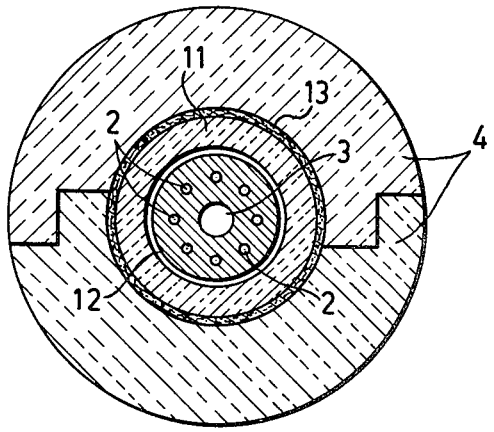
FIG. 4 shows a cross-section through a lower region of the metallic top portion wherein the mouldings comprise segments.

FIG. 2 as well as FIG. 4 disclose the use of half shells joined together or of rings, for example graphite, provided with an insulating coating and of conductive felt 13, for example made of a carbon fibre. An electrically conductive protective ring, for example of a ceramic such as $ZrO_2$, $SnO_2$, SiC, or graphite is additionally inserted between the advanced, internally disposed metal part 12 and the conductor itself 13. The use of a conductive, vibration damping material such as felt and the like, in combination with electrically conductive solid components of ceramic or graphite is particularly preferred for the electrode according to the invention. Hooklike insulation supports 14 may optionally be employed adjacent the upper region of the metallic portion 5 where slideability may not be desired. Lateral motion of the mouldings 4 may be constrained as shown in U.S. application Ser. No. 438,582 or in any suitable or conventional manner.

Figure 3:
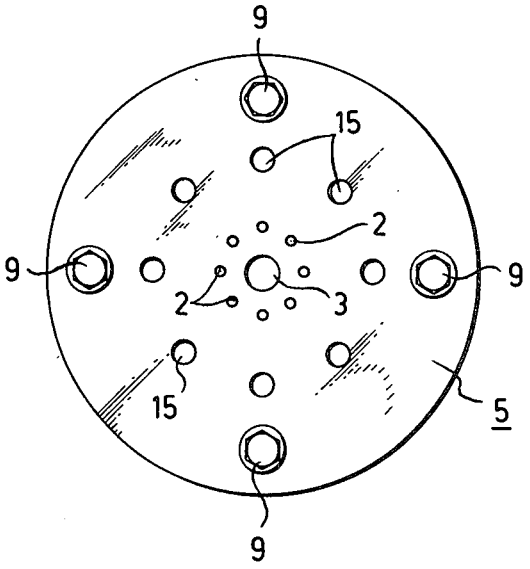
FIG. 3 shows a top view of the electrode of FIG. 1.

FIG. 3 is a top view of the metallic portion 5, showing cooling ducts 2, 3, upper region cooling ducts 15 and the biasing pins 9.

While a preferred embodiment of the invention has been shown and described in detail, it should be apparent that various modifications and alterations may be made thereto without departing from the scope of the claims that follow.

What we claim is:

1. A metellurgical arc furnace having an electrode, said electrode comprising: an electrical current conducting metallic top portion and a consumable, replaceable bottom portion, a threadable interconnection between the portions; the top portion including a cooling means having a supply and return, each extending longitudinally through the top portion; the top portion including at least one insulation support; and a plurality of ring-like insulative moulding sections having an inner diameter sufficiently in excess of an outer diameter of the top portion whereby, when the furnace is in operation, the moulding section slideably surrounds at least a portion of the top portion.

2. The electrode of claim 1 the moulding sections being tubular.

3. The electrode of claim 1, the moulding sections and external edges of the top portion not surrounded by the mouldings being substantially flush each with the other.

4. The electrode of claim 1, the insulative moulding sections being at least partially supported by the threadable interconnection.

5. The electrode of claim 1, an insulation support being provided on said top portion including an abutment, positioned adjacent the threadable interconnection, the insulative mouldings being supported upon the abutment below the upper region.

6. The electrode of claim 1, the top portion including an upper region of a relatively larger diameter and a lower region of a relatively smaller diameter, the upper region including a plurality of longitudinal bores, shafts being received one within each such bore, the shafts including a spring for biasing the shafts downwardly along the electrode, and the shafts including a portion for contacting the insulative mouldings whereby the insulative mouldings are downwardly biased along the lower region of the upper portion.

7. The electrode of any one of claims 1-6 including a plurality of ring-like intermediate sections configured to closely surround the lower region, intermediate sections being introduced between the insulative moulding and the lower region of the upper portion.

8. The electrode of claim 7, the intermediate sections being formed of a fabric material having an elevated temperature stability.

9. The electrode of claim 1, the portion of the top portion surrounded by the moulding being coated with a stressable electrically conductive coating.

10. The electrode of claim 9, the coating being a ceramic coating.

11. The electrode of claim 1, the insulative moulding section being formed from ceramic and graphite having a substantially elevated resistance to elevated temperature.

12. The electrode of claim 1, the insulative moulding comprising tubular sections formed from graphite and covered with an electrically insulative coating.

13. The electrode of claim 7, the intermediate sections being formed from an electrically conductive ceramic.

14. The electrode of claim 7, the intermediate sections being formed from graphite.

15. The electrode of claim 7, the intermediate sections being formed from a fabric including at least one of mineral fabric and ceramic materials.

16. The electrode of claim 7, the intermediate sections being formed from a felt.

17. The electrode of claim 7, including a plurality of insulative mouldings at least one such moulding and at least one intermediate section being mounted on retainers, the retainers being attached to the lower region.

18. The electrode of claim 1, the insulative moulding adjacent the top region of the upper portion being an insulating, injectible refractory compound, the upper region of the top portion including at least one retaining member to which the insulating, injectible refractory compound is anchored.

19. The electrode of claim 7, the intermediate sections and the insulative moulding being configured for slideable longitudinal movement along the top portion to effect replacement of damaged sections of such intermediate and/or insulative moulding which become detached from the lower region.

* * * * *